US006474226B1

(12) United States Patent
Sutton et al.

(10) Patent No.: US 6,474,226 B1
(45) Date of Patent: Nov. 5, 2002

(54) BALING APPARATUS AND METHOD

(75) Inventors: Gregory Bryan Sutton, Jacksonville, FL (US); Dennis E. Finegan, Green Cove Springs, FL (US); Mark E. Lindsey, Jacksonville, FL (US)

(73) Assignee: LoadKing Manufacturing Co., Jacksonville, FL (US)

( * ) Notice: Subject to any disclaimer, the term of this patent is extended or adjusted under 35 U.S.C. 154(b) by 0 days.

(21) Appl. No.: 09/496,830

(22) Filed: Feb. 2, 2000

(51) Int. Cl.[7] ..... B30B 15/32; B65B 13/20

(52) U.S. Cl. ..... 100/3; 100/34; 100/218; 100/255; 100/295

(58) Field of Search ..... 100/3, 34, 240, 100/245, 246, 252, 255, 269.13, 295, 218

(56) References Cited

U.S. PATENT DOCUMENTS

| | | | | |
|---|---|---|---|---|
| 131,805 | A | * 10/1872 | Yarrell | 100/255 |
| 705,134 | A | * 7/1902 | Pope et al. | 100/3 |
| 797,997 | A | * 8/1905 | Webb | 100/3 |
| 2,570,757 | A | * 10/1951 | Bowman et al. | 100/3 |
| 3,195,445 | A | * 7/1965 | Meisler | 100/295 |
| 3,228,166 | A | * 1/1966 | Thiele | 100/3 |
| 3,911,807 | A | 10/1975 | Birnbaum | |
| 3,913,475 | A | * 10/1975 | Clar | 100/245 |
| 3,916,781 | A | * 11/1975 | Cerniglia | 100/245 |
| 3,924,871 | A | * 12/1975 | Mesenbring | |
| 4,057,009 | A | 11/1977 | Burford et al. | |
| 4,092,912 | A | 6/1978 | Simich | |
| 4,232,599 | A | 11/1980 | Ulrich | |
| 4,541,332 | A | * 9/1985 | Horansky et al. | 100/3 |
| 4,953,344 | A | * 9/1990 | Wallace | 100/295 |
| 5,247,880 | A | 9/1993 | Robbins | |
| 5,353,698 | A | 10/1994 | Robbins | |
| 5,570,630 | A | 11/1996 | Molitorisz et al. | |
| 5,575,199 | A | 11/1996 | Yamamoto | |
| 5,632,199 | A | 5/1997 | Molitorisz et al. | |
| 5,852,969 | A | 12/1998 | Anthony | |

FOREIGN PATENT DOCUMENTS

| | | |
|---|---|---|
| DE | 296 15 598 | 12/1996 |
| EP | 0 810 083 A2 | 12/1997 |
| NL | 1001039 | 2/1997 |

OTHER PUBLICATIONS

Compact 750 Baler "Waste Management for the New Millennium" (date unknown).

Kenburn Bale Presses Single Chamber (date unknown).

GPI Model M60HP Baler (date unknown).

DIXI Baler Systems 6/97.

Marathon V–6030HD High–Density Recycler 1993.

Philadelphia Tramrail Hydraulic Balers (date unknown).

HSM Baling Presses 6/98.

* cited by examiner

*Primary Examiner*—Stephen F. Gerrity
(74) *Attorney, Agent, or Firm*—Allen, Dyer, Doppelt, Milbrath & Gilchrist, P.A.

(57) ABSTRACT

A vertical baler includes a horizontally disposed floor plate having an arched surface for receiving material to be compacted thereon. A compression plate is mounted for reciprocating vertical movement with respect to the floor plate, and left and right hydraulic pistons carried outside the wall of the baler are operably attached between the floor plate and the compression plate for reciprocating the compression plate relative to the floor plate. Material placed between the arched floor plate and the compression plate is compacted and formed with an arched bottom surface for ease in sliding fork elements of a lift truck thereunder. Once compacted and tied, the bale is pushed from the compaction chamber by pusher tabs vertically extending from a rear edge of the floor plate which is operable for horizontal reciprocation causing biasing of the pusher tabs against the material in a horizontal pushing of the bale from the chamber onto an adjacent floor surface. To enhance formation of the bale having a desired arched bottom shape, struts are carried on a top surface of the floor plate for forming a depression within the bale formed during the compression of the material. Yet further shaping of the bale is provided by a pair of opposing struts extending along opposing edges of the compression plate, for providing enhanced compression of the material along lower opposing edge portions of the floor plate.

37 Claims, 13 Drawing Sheets

BALING APPARATUS AND METHOD

FIELD OF THE INVENTION

The present invention relates to compaction and baling of waste materials such as paper and cardboard, and in particular to a baling apparatus for forming and discharging a bale for efficient handling thereof.

BACKGROUND OF THE INVENTION

Both horizontal and vertical styled baling machines are well known in the art, as described by way of example with reference to U.S. Pat. Nos. 5,353,698 to Robbins and 4,057,009 to Burford et al. Overhead limitations make a horizontal baler attractive for use, yet added floor space is needed when compared to the vertical baler. Typically, a vertical baler will eject the bale by rolling or flipping the bale onto adjacent floor space making it hazardous for an operator standing near the baler. The horizontal baler of Robbins '698 pushes the bale from a compaction chamber at a level above the floor in order to locate a lift truck for receiving the bale. It would be desirable to push bales onto the floor directly, but difficulty comes when an operator attempts to move the bale by singlehandedly moving the bale for placing the lift forks under the bale, making safety an issue. With further regard to safe operation, an operator must take care to stand clear of the compaction chamber when a gate, such as described, by way of example only, in the Burford '009 patent is opened for depositing waste material to be compacted.

Therefore, in spite of the variety of baling machines available, there remains a need to provide for the ejection of a bale directly onto the floor while still providing ease in handling of the bale by a lift truck. There is further a need to provide for the safe operation of the baling machine by the operator who may spend hours operating the baler or only casually operate it in performing a part of his duties.

SUMMARY OF THE INVENTION

In view of the foregoing background, it is therefore an object of the present invention to provide a baler that addresses the needs of minimal space requirements relative to bale size, and provides a bale shape that is effectively handled by typically available handling equipment such as fork lifts and lift trucks. It is further an object to provide for safe operation of the baler by an operator.

These and other objects, advantages and features of the present invention are provided by a baling apparatus comprising a horizontally disposed floor plate having an arched surface for receiving material to be compacted thereon. A compression plate is mounted for reciprocating vertical movement with respect to the floor plate, and reciprocating means are operably attached between the horizontally disposed floor plate and the compression plate for reciprocating the compress floor plate, wherein material placed between the arched floor plate and the compression plate is compacted therebetween for forming an arched bottom surface therein. Pusher tabs vertically extend from an edge of the floor plate which floor plate is operable for horizontal reciprocation causing biasing of the pusher tabs against the material in a horizontal pushing movement, wherein material compacted between the compaction plate and the floor plate is pushed from the chamber onto an adjacent support surface.

To enhance formation of a bale having a desired arched bottom shape, at least one elongate strut is carried on a top surface of the floor plate for forming a depression within the bale formed during the compression of the material. Alternatively, two struts spaced for enhancing slidable movement of a fork lift under a bale formed by the apparatus. An alternate embodiment includes pusher tabs extending from rear edges of the strut. For yet further shaping of the bale, a pair of opposing struts extends along opposing edges of the compression plate, wherein compression of the material along lower opposing edge portions of the floor plate.

A method aspect of the present invention includes the steps of horizontally disposing the floor plate onto a base for providing a closed bottom end of the chamber, wherein the floor plate comprises the arched top surface for forming an arched bottom surface of the compacted material. Material to be compressed is loaded into the chamber, and the material compressed by reciprocating the compression plate relative to the chamber, wherein the material is compacted between the compression plate and the arched top surface of the floor plate.

BRIEF DESCRIPTION OF THE DRAWINGS

A preferred embodiment of the invention, as well as alternate embodiments are described by way of example with reference to the accompanying drawings in which.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
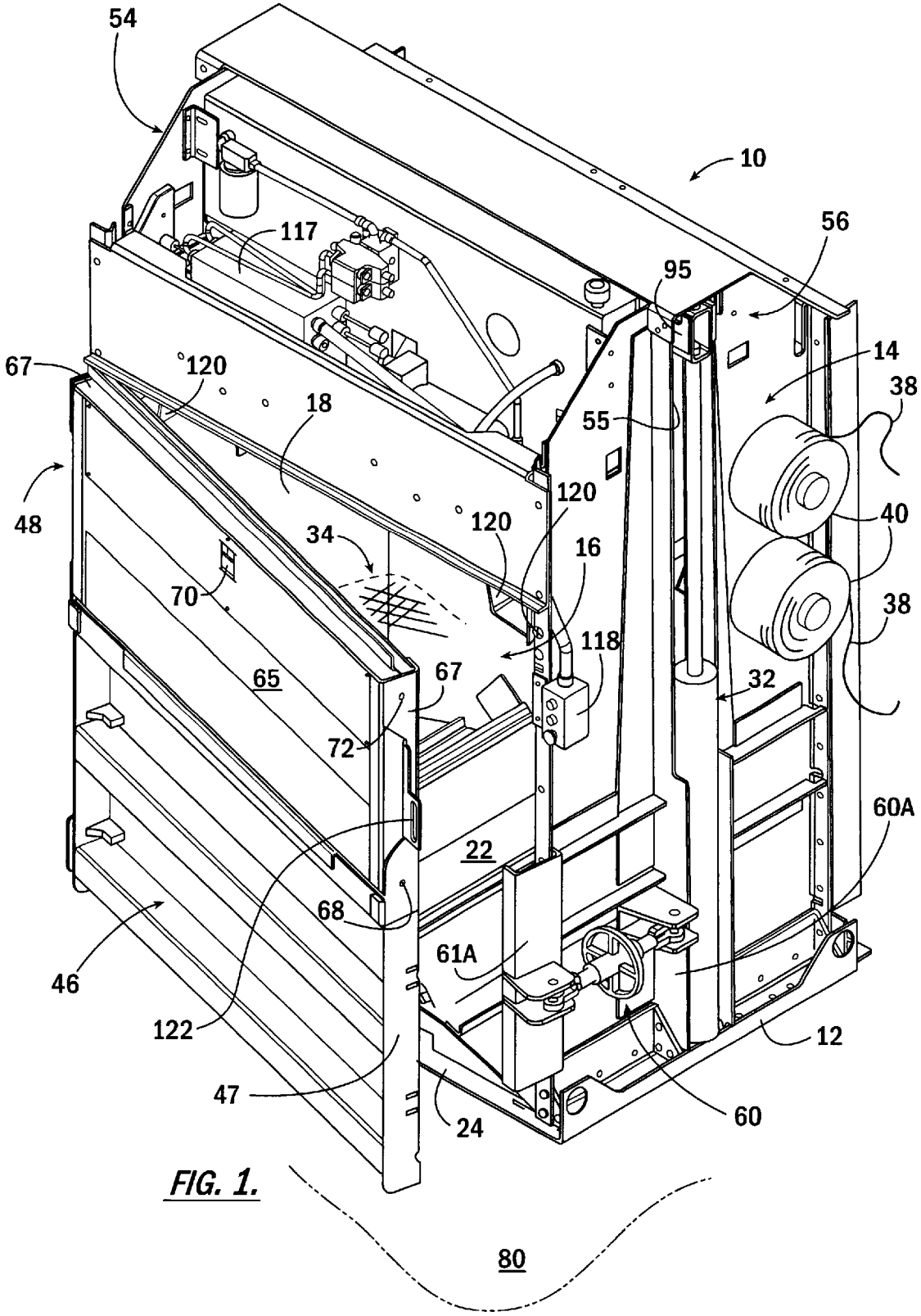
FIG. 1 is a right front and top perspective view of a baling apparatus of the present invention, illustrated with a top cover removed for viewing hydraulics and controls electronics carried within a tip portion thereof.
Figure 2:
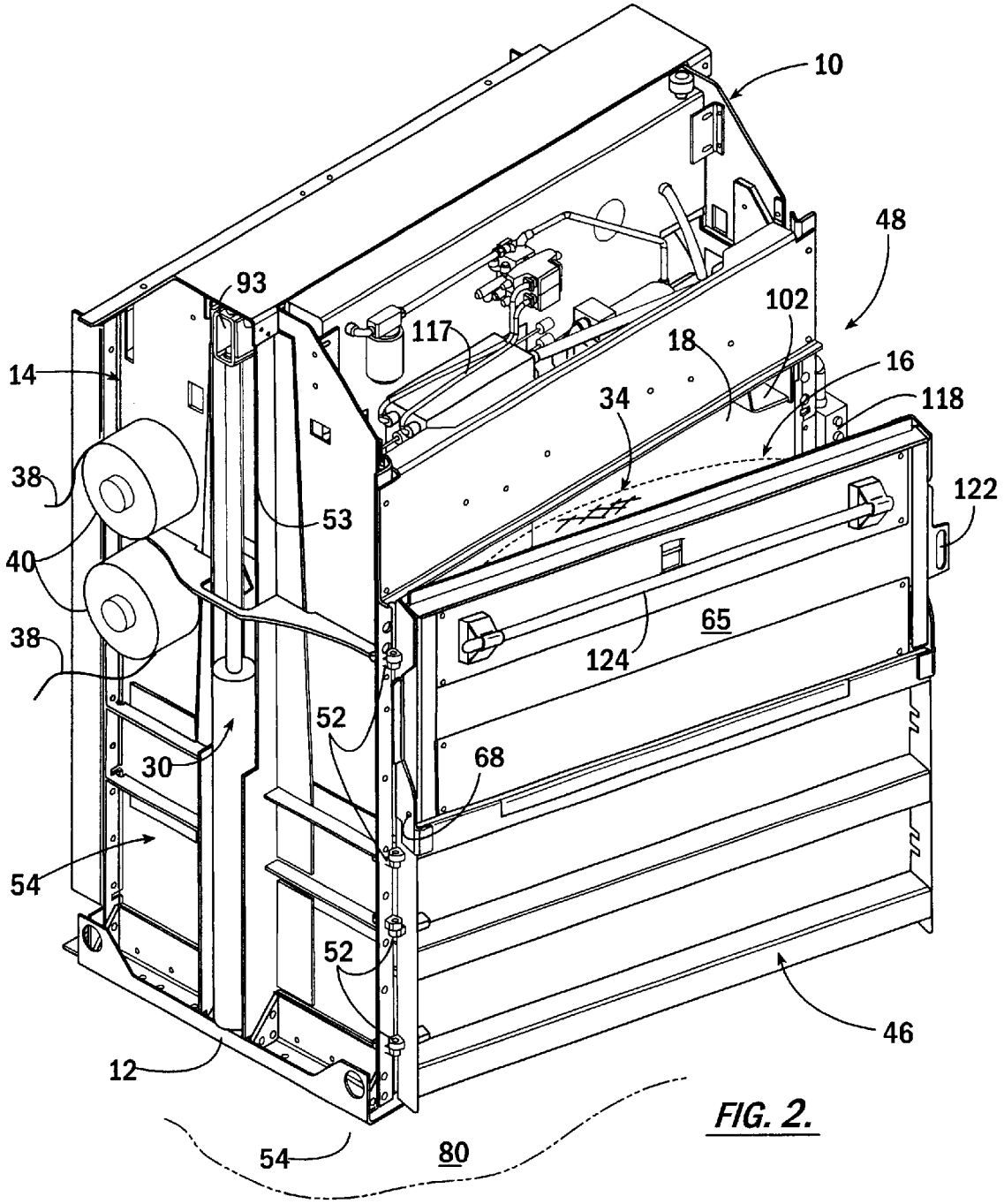
FIG. 2 is a left front perspective view of FIG. 1, illustrating a door in an open position.
Figure 3:
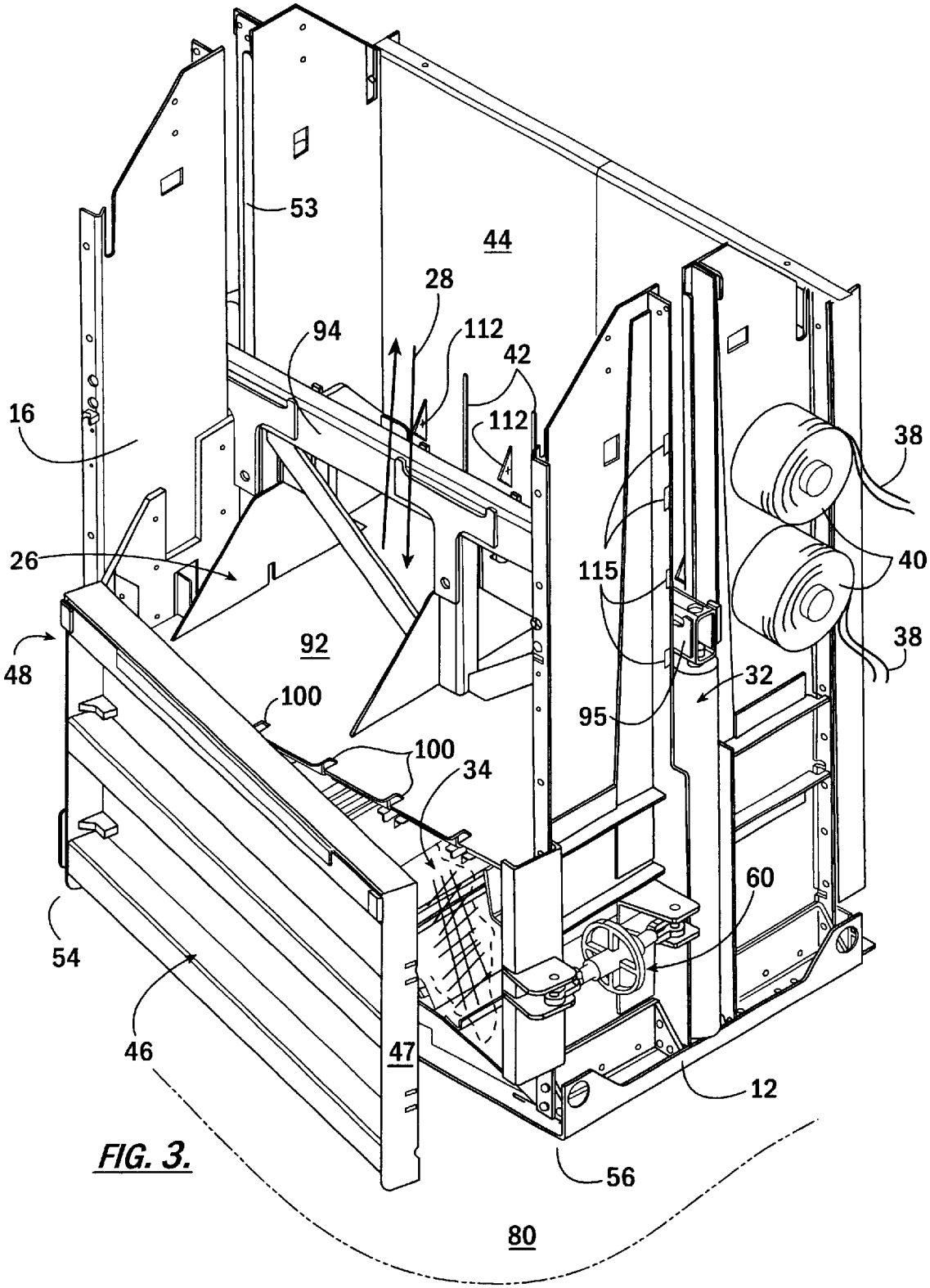
FIG. 3 is a partial perspective view of the apparatus of FIG. 1 illustrating a compacting position of a compression plate.

With reference initially to perspective views of FIGS. 1, 2 and 3, one preferred embodiment of a baling apparatus 10 of the present invention comprises a base 12 and a wall 14 extending vertically upward from the base for defining a compaction chamber 16 having an open top end 18. A horizontally disposed floor plate 20 having an arched top surface 22 is fixedly attached to the base 12 for providing a closed bottom end 24 of the chamber 16. A compression plate 26 is mounted above the base 12 for reciprocating movement 28 within the chamber 16. Left and right hydraulic piston assemblies 30, 32 carried outside the wall 14 provide means for reciprocating the compression plate 26 relative to the chamber 16, toward and away from the floor plate 20, such that waste material 34 loaded into the chamber 16 is compacted between the compression plate and the floor plate while confined within the vertically extending wall 14. Each of the hydraulic piston assemblies 30, 32 is operably connected between the base 12 and the compression plate 26, which plate will be further detailed later in this section.

Figure 2A:
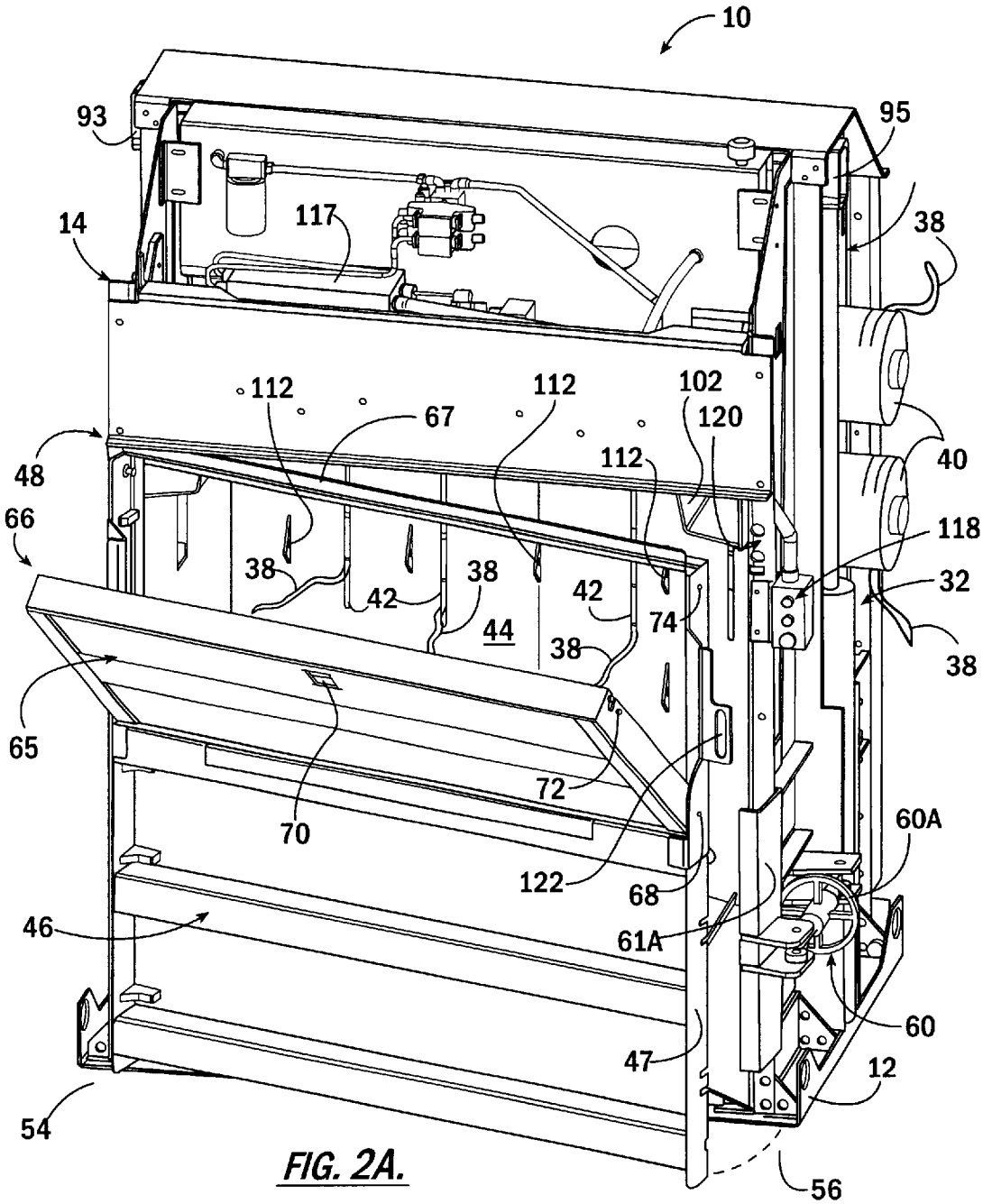
FIG. 2A is a front right perspective view of the embodiment of FIG. 1 illustrating a feed gate in an open position.
Figure 4:
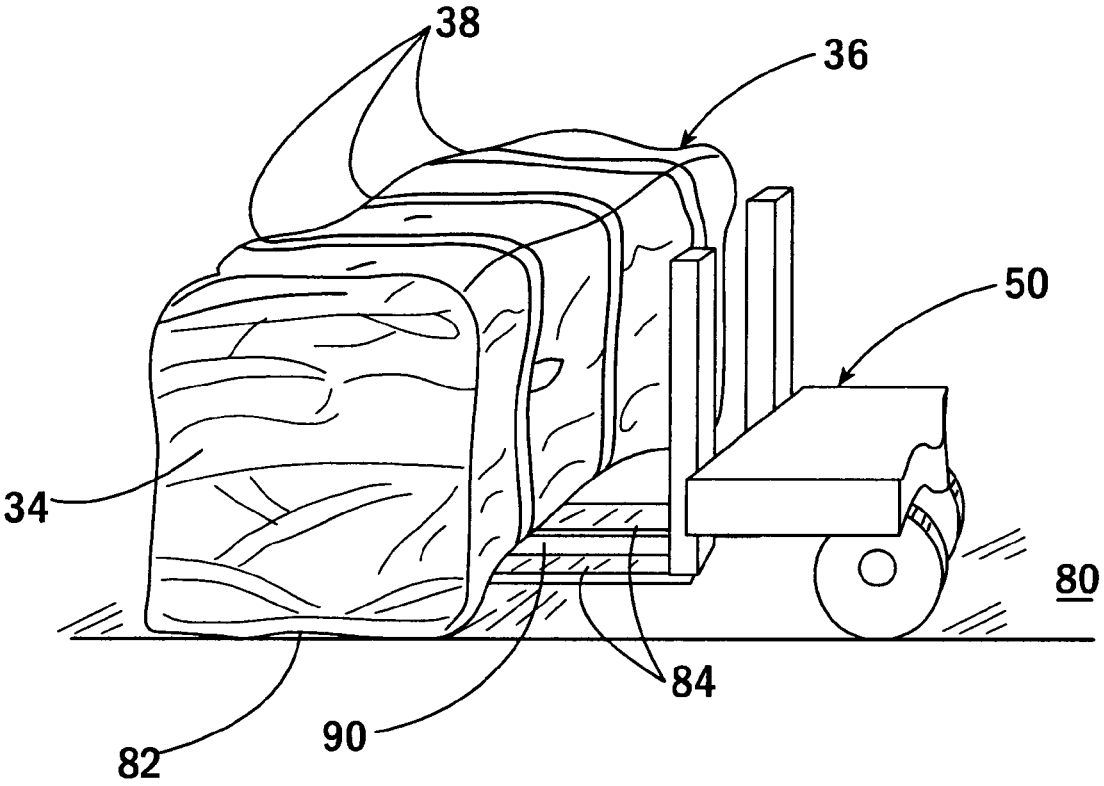
FIG. 4 is a perspective view of a bale prepared using the apparatus of the present invention.

For the apparatus 10, herein described by way of example, baling of the compacted waste material 34 is completed manually for providing a bale 36 as illustrated, by way of example, with reference to FIG. 4. In one embodiment of the present invention, strapping means is provided by strapping 38 stored on reels 40 for manually feeding through slots 42 within a rear wall section 44, as illustrated with reference again to FIG. 2A, and placement over the floor plate 20 prior to loading of waste material into the chamber 16, as earlier described. After compaction of the waste material 34, a chamber door 46, located on a front wall section 48, is opened and the compacted waste material 34 tied after manually feeding the strapping 38 around the waste material and while the compression plate 26 maintains compaction of the material. After the waste material 34 is tied and the fabrication of the bale 36 completed, pressure placed onto the waste material is released and the bale is then pushed from the chamber 16 for handling by a lift truck 50, by way of example, as will be further detailed later is in this section. Various strapping and tying methods and materials, well known in the art, may be used in completing the tying of the bale without departing from the intent and teachings of the present invention.

Figure 1A:
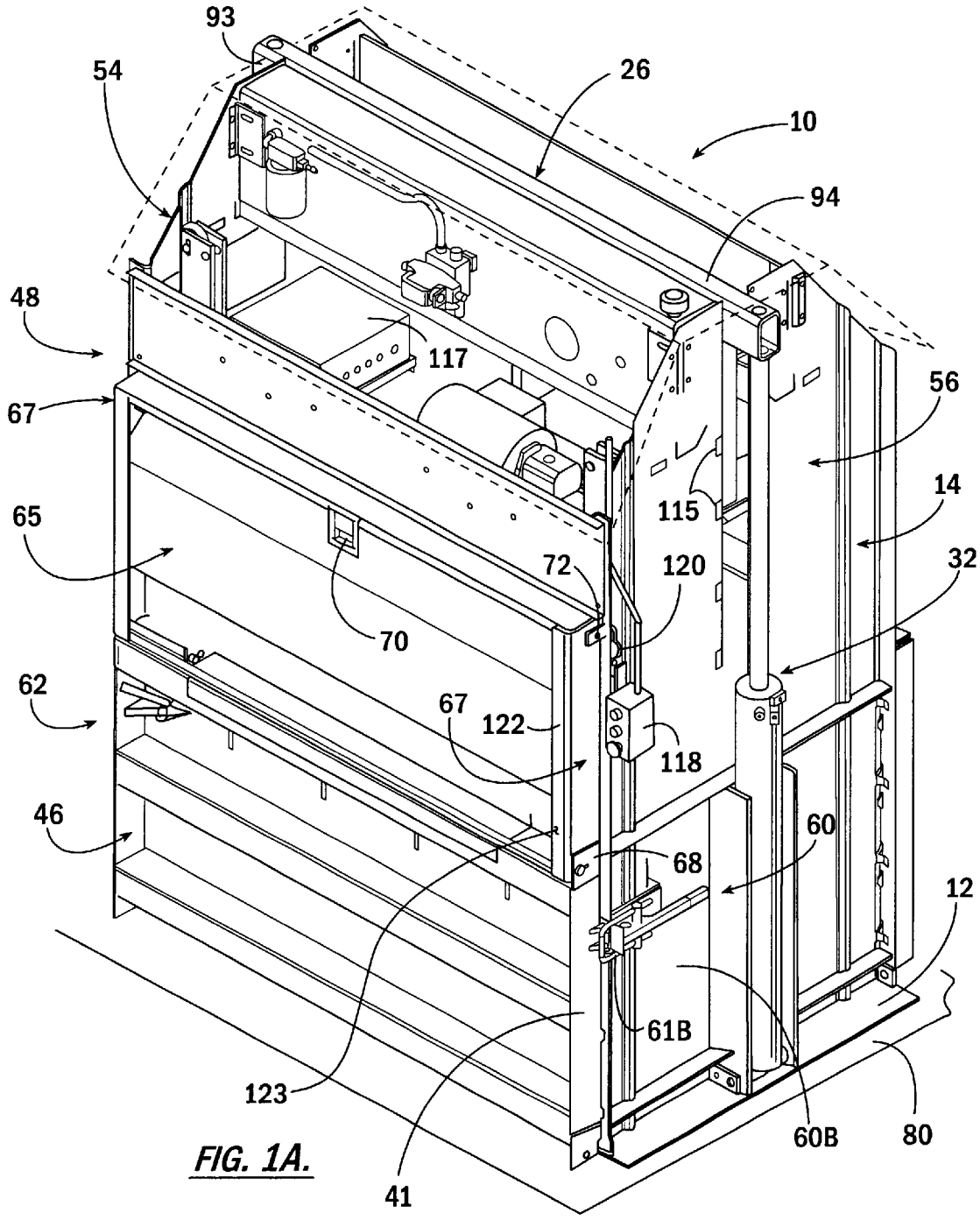
FIG. 1A is the embodiment of FIG. 1 illustrating a closed operable position.
Figure 5:
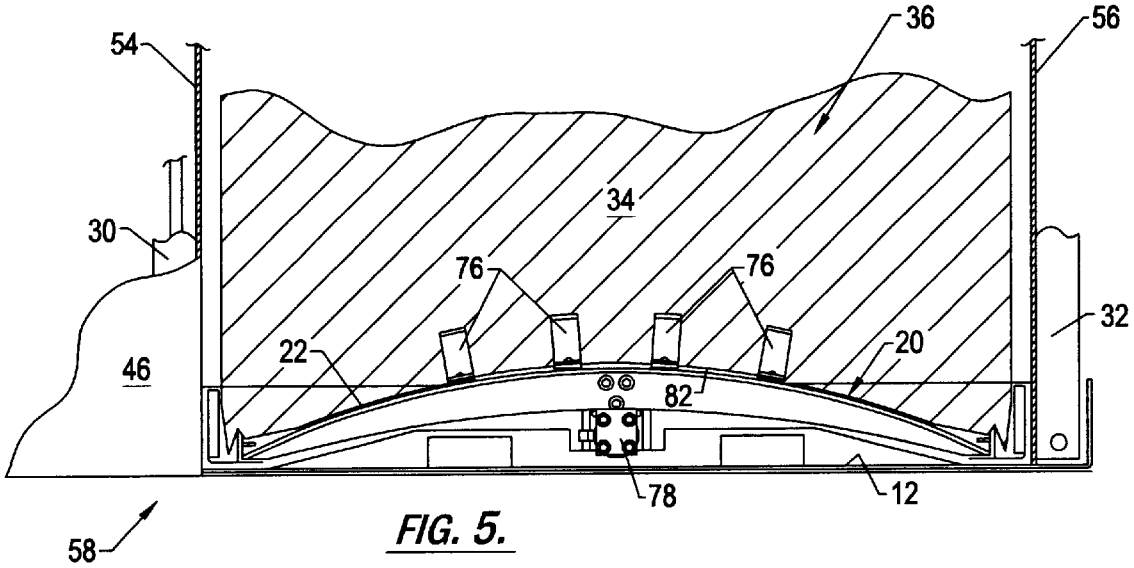
FIG. 5 is a partial front elevation view of the apparatus of FIG. 1 in a door open position illustrating exposure of a floor plate carrying waste material.

As illustrated with reference to FIG. 1A, the chamber door 46 forms a portion of the front wall section 48 of the wall 14. The chamber door 46 is pivotally secured using hinges 52 attached along a left side wall section 54, and is latched at the right side wall section 56, as herein described and alternatively latched on the left side as desired. The chamber door 46, as earlier described, provides access to the chamber 16 for exposing the compacted waste material 34 compressed onto the arched top surface 22 of the floor plate 20 for slidable movement of the waste material from the chamber when the chamber door is in an open position 58, as illustrated with reference to FIG. 5.

Figure 6:
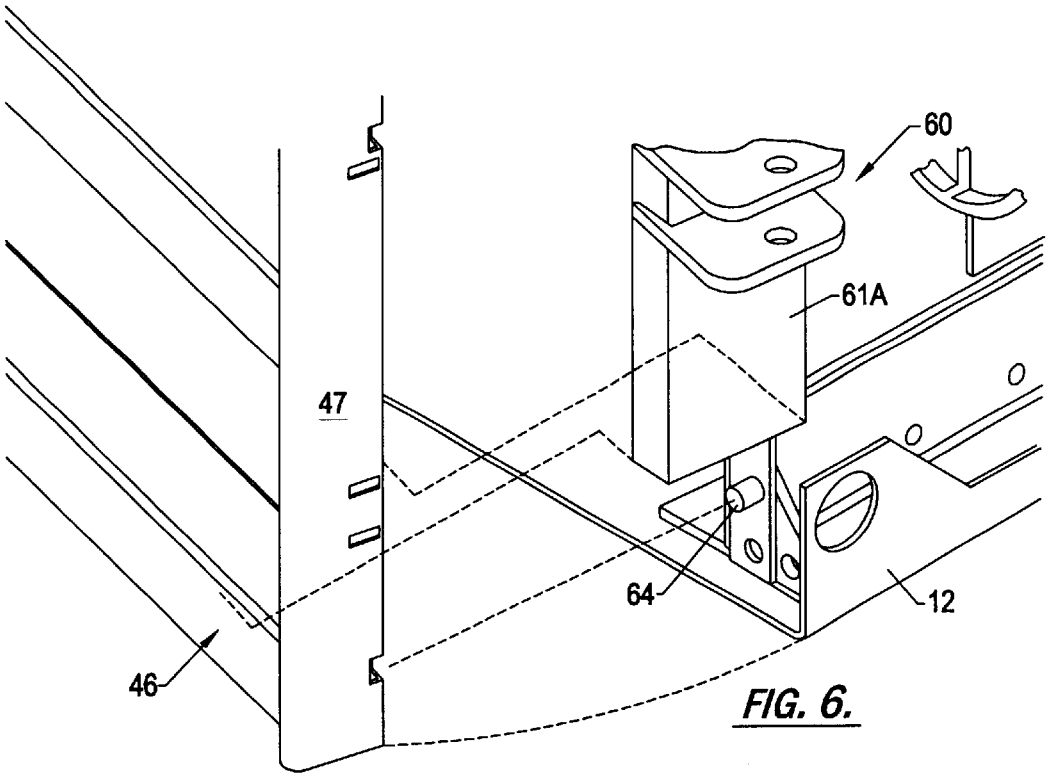
FIG. 6 is a partial perspective view of locking pins operable with the chamber door.

As illustrated with reference again to FIG. 1, a door latch 60 secures the door 46 in a closed position 62 as illustrated with reference to FIG. 1A. Alternate embodiments of the door latch 60A include the wheel styled latch illustrated with reference to FIG. 1, and the lever arm styled latch 60B, illustrated with reference to FIG. 1A, by way of examples. The wheel styled latch 60A includes a bracket 61A which is latched to an edge portion of the door 46, with the wheel rotated to secure the door in the closed position 62. The latch 60B includes a pivotal lever arm and clamp 61B to secure the door in the closed position. To further secure the chamber door 46, locking pins 64 are fixedly attached to the edge of the right side wall section 56 for mating with slots carried within the door 46 for a locking engagement of the chamber door 46 with the right wall section 56, as illustrated with reference to FIG. 6, by way of example.

As illustrated with reference again to FIGS. 1 and 1A, the baling apparatus 10 further comprises a feed gate 65: pivotally secured using a spring loaded pivot pin within a frame 67 integrally formed with the chamber door 46. The feed gate 65 provides access to the chamber :16 above the chamber door 46 and through an opening of the frame 67 for loading the waste material 34 into the chamber when the feed gate is in an open position 66and the door in the closed position 62. By pivoting about horizontally aligned hinge pins 68, the feed gate 65 acts as a slide for loading the waste material 34 and serves to keep an operator distanced from the compaction chamber 16 and compression plate 26, adding safety to the operation of the baling apparatus 10. In addition, the feed gate 65 and the chamber door 46 can be simultaneously opened through the hinged action of the frame 67, as illustrated with reference again to FIG. 1. A gate latch 70 is operable for insertion and removal of latch pins 72 into holes 74 carried within the left and right vertical frame sections.

Figure 7:
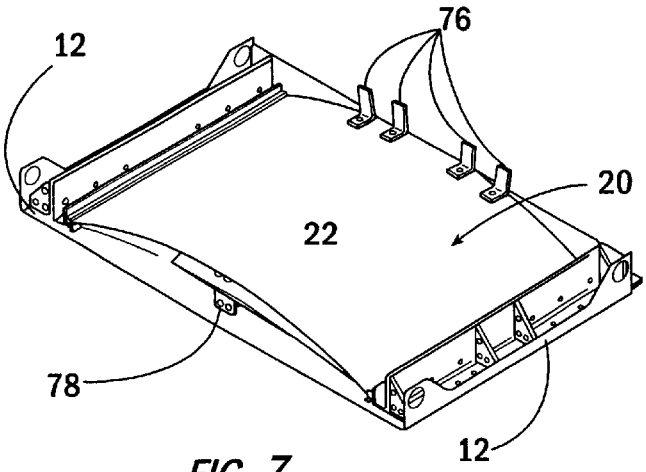
FIGS. 7 and 8 are partial perspective and top plan views of a floor plate of FIG. 5.
Figure 8:
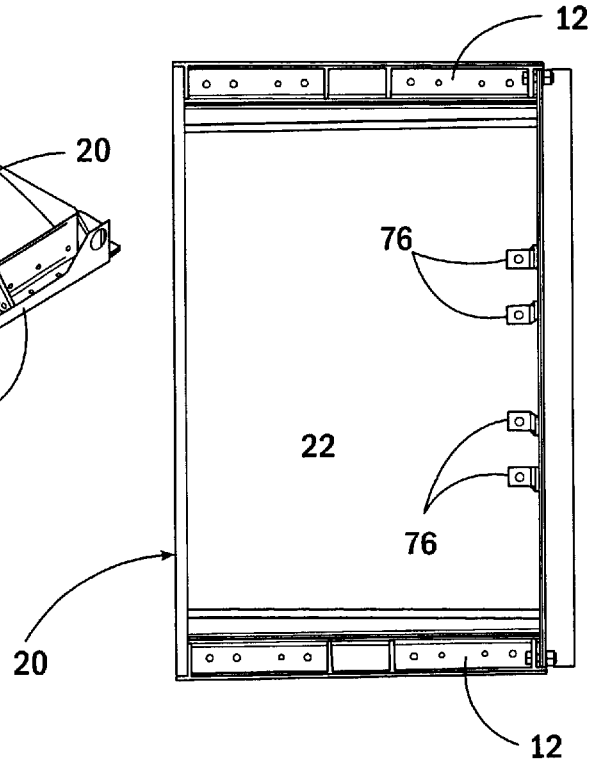
Figure 9:
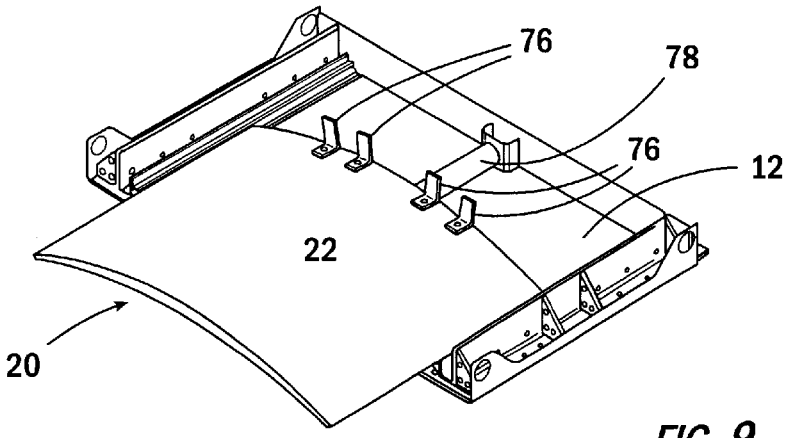
FIG. 9 is a partial perspective view of the floor plate of FIG. 7 is a displaced position.
Figure 10:
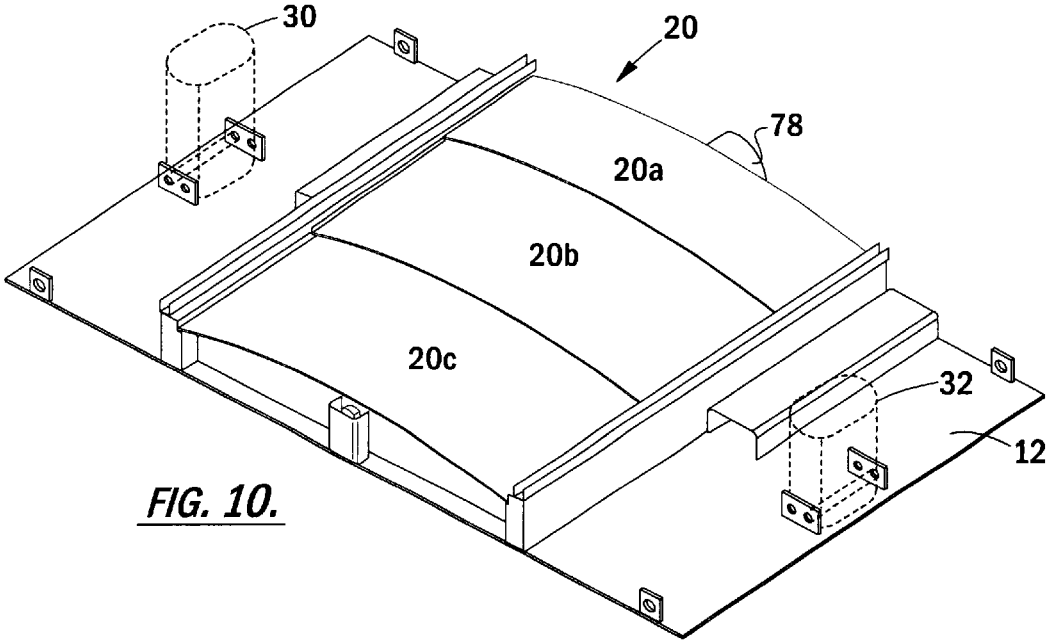
FIG. 10 and 11 are partial perspective and front elevation views of an alternate telescoping floor plate of the present invention.
Figure 11:
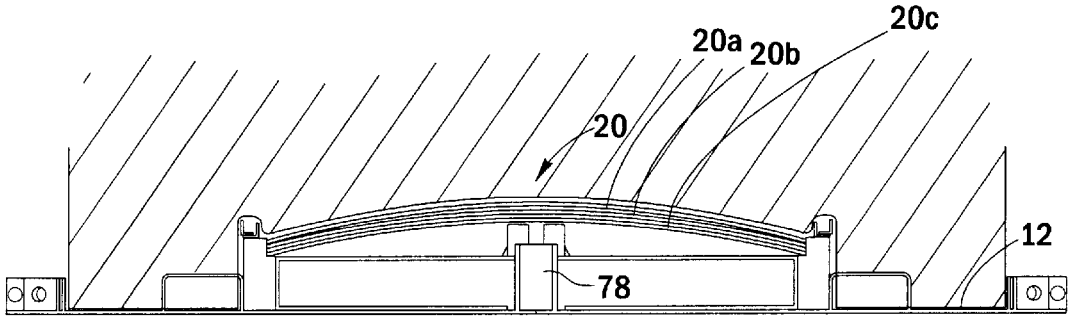

As illustrated with reference again to FIG. 5, and to FIGS. 7–9, pusher tabs 76 are attached to a rear edge of the floor plate 20 and extend vertically therefrom for cradling the waste material 34 deposited onto the floor plate. The floor plate 20 is reciprocated by a floor plate piston assembly 78 for horizontal movement out of and into the chamber 16 when the chamber door 46 is in the open position 58, wherein the bale 36 formed from the compacted waste material 34 is pushed from the chamber 16. The pusher tabs 76 bias against an edge of the bale 36 in a pushing movement, while the floor plate slides back into the chamber 16 in the retracting movement, after depositing the bale onto a support surface 80 adjacent the apparatus 10, as the retracting bale makes contact with the wall 14 of the apparatus and the support surface 80 allowing the bale to slide off of the floor plate 20 as the plate is retracted. In an alternate embodiment, and as illustrated with reference to FIGS. 10 and 11, the floor plate 20 comprises a plurality of telescoping plate sections 20*a*, 20*b*, 20*c*. In yet another embodiment, the bale 36, tied and ready for removal from the chamber 16, is removed therefrom using the lift truck 50, by way of example, after the left and right side wall sections 54, 56 are outwardly hinged from the rear wall section 44 to allow the fork elements 84 to contact the bale after biasing of the side wall sections against the bale is removed. The bale 36 is then removed using the fork elements 84 without the need to push the bale from the chamber 16.

Figure 3A:
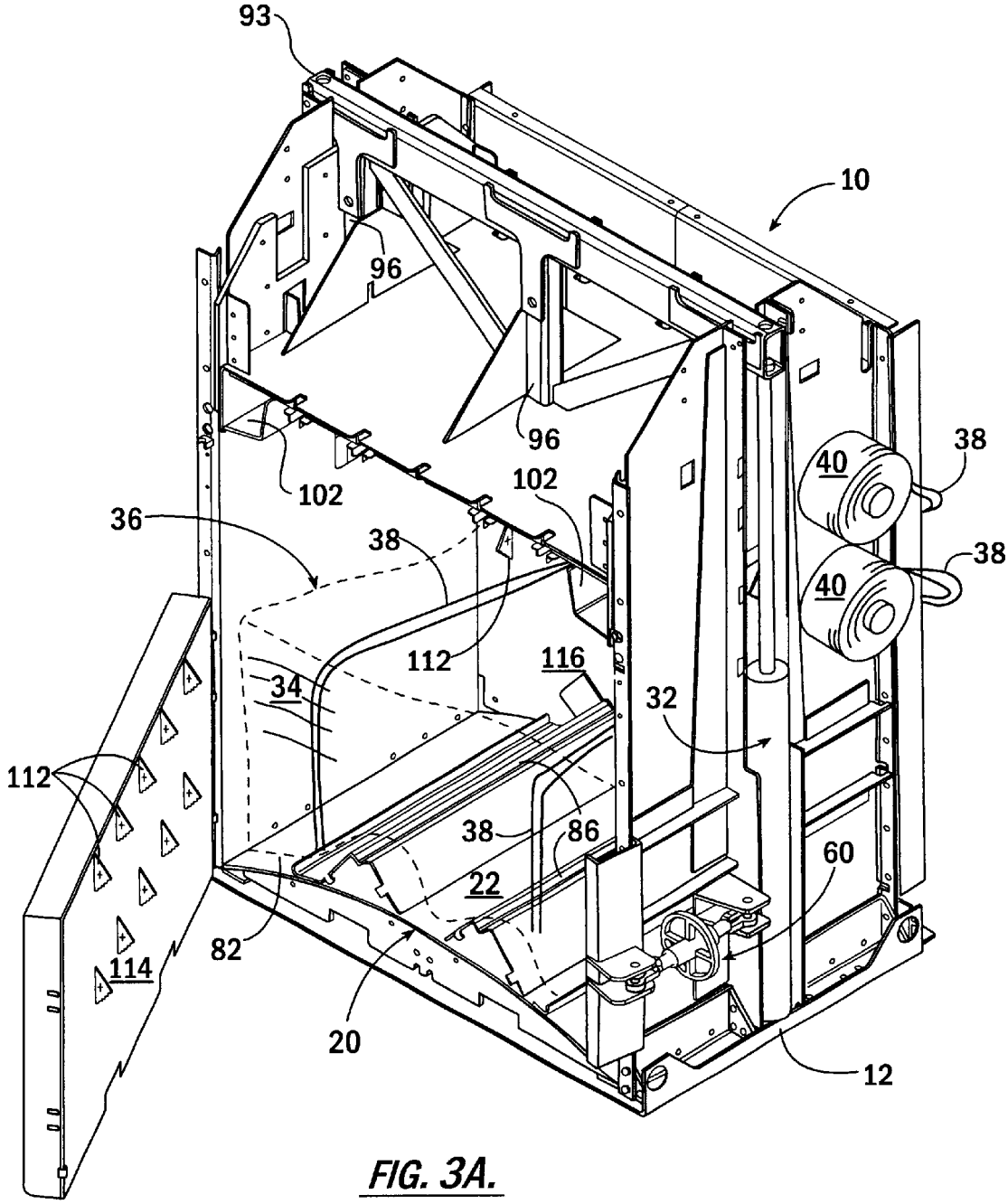
FIG. 3A is a partial perspective view of FIG. 3 illustrating a compression plate in a raised position with the door opening for access to a bale.

As illustrated with reference again to FIGS. 4 and 5, the arched top surface 22 of the floor plate 20 causes a desired arched bottom surface 82 of the bale 36 allowing fork elements 84 of the lift truck, by way of example, to easily slide under the bale. Because of the variables in the compacting process and the variety of waste materials compacted, a bale can deform after compacting. As a result, there is a need to shape the bale 36 such that any deformation will not hamper the handling operation by the lift truck 50. An alternate embodiment of the present invention, as illustrated with reference to FIGS. 3A and 12, comprises a pair of elongate struts 86 carried on the arched top surface 22 of the floor plate 20 for forming depressions 88 within the bottom surface 82 of the bale 36 during the compression of the waste material 34. It is anticipated that a single strut 86, and various spacings between strut pairs will be useful depending on the type of waste material being compacted. The addition of the struts 86 has been shown to enhance the shaping of the bale 36 and the shape of the cavity 90 formed by the support surface 80 and the bale bottom surface 82 for providing ease in movement of the fork elements 84 under the bale 36.

Figure 12:
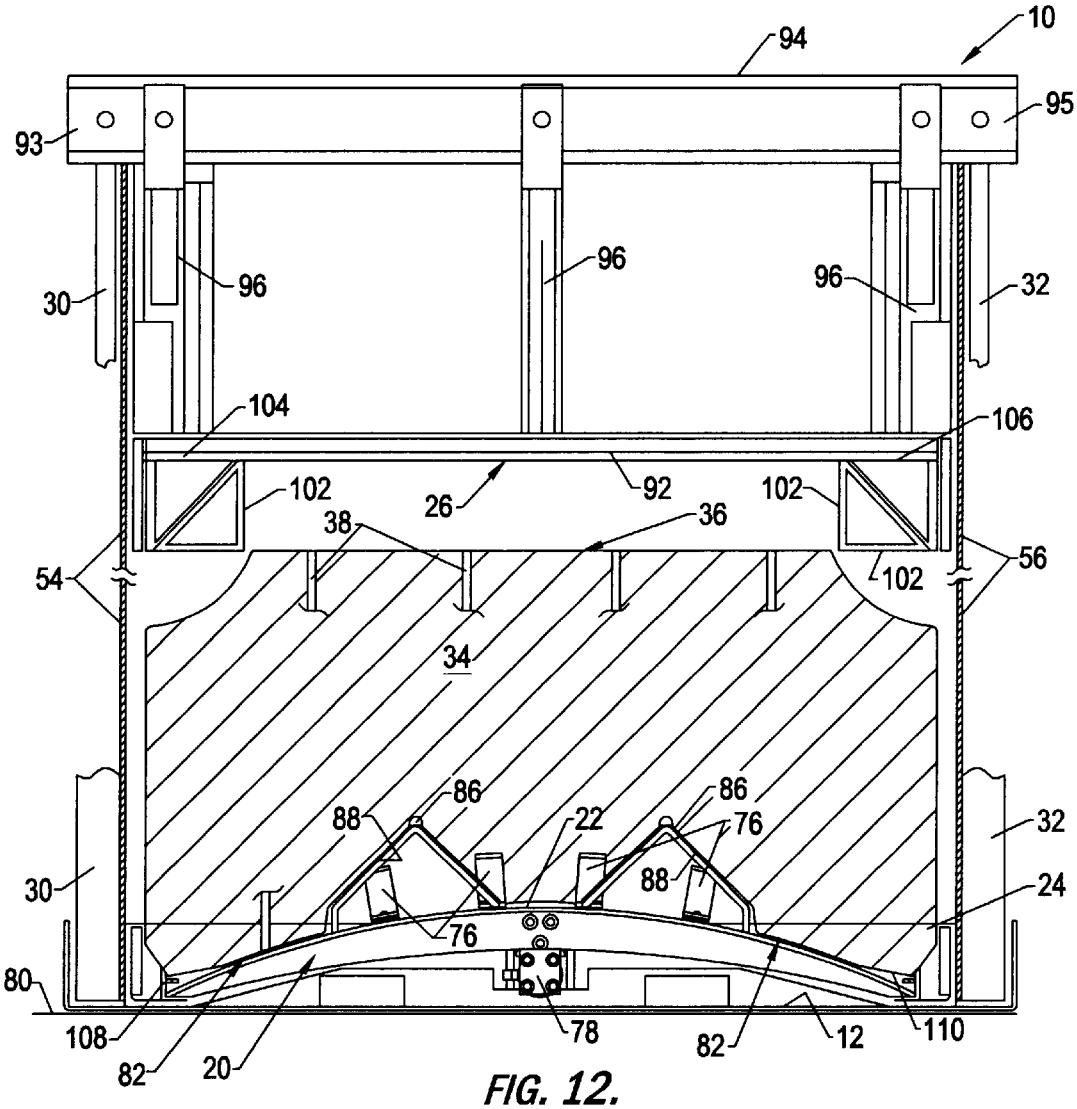
FIG. 12 is a partial front elevation view illustrating one compression plate and floor plate of the present invention.
Figure 13:
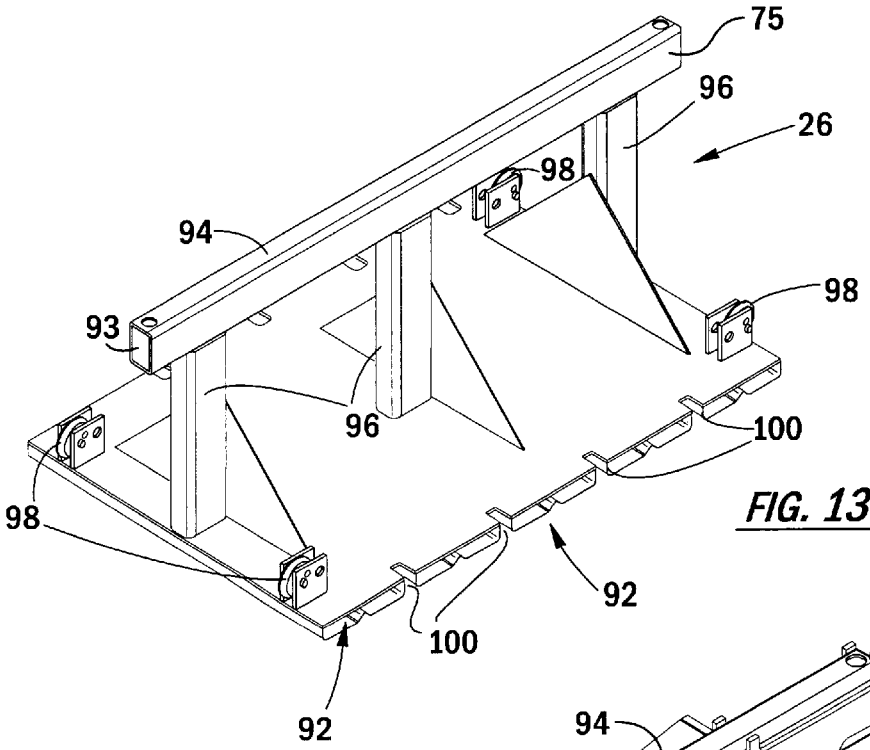
FIGS. 13 and 13A are partial perspective views of alternate compression plate embodiments of the present invention.
Figure 13A:
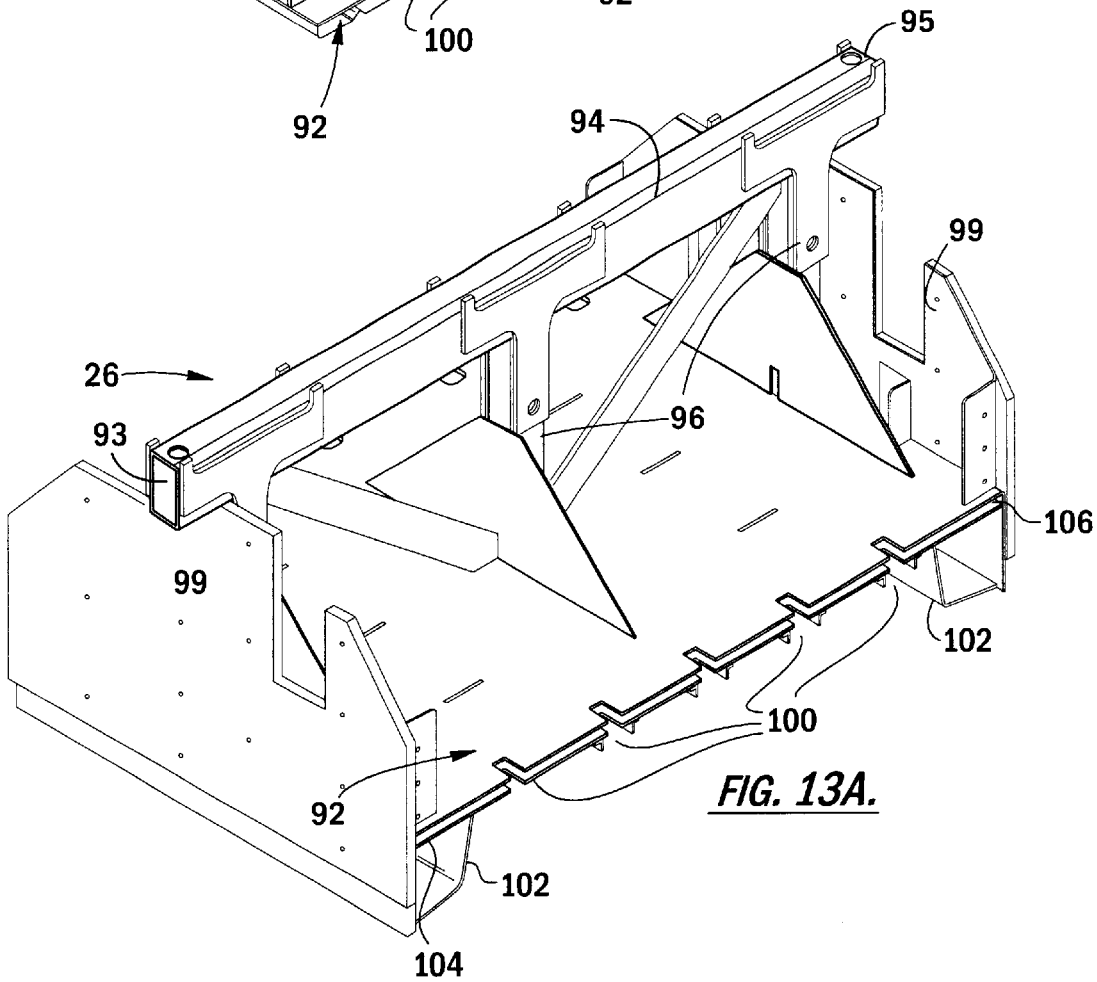

As illustrated with reference again to FIG. 3 and to FIG. 12, the compression plate 26 in one preferred embodiment herein described by way of example, comprises a plate member 92, and a beam 94 connected to the plate member by vertical support members 96 for securing the beam in a spaced and rigid relation to the plate member. Various lengths for the support elements 96 can be used to provide a desired displacement of the plate member 92 and thus through of the compression plate 26, further assuring the use of minimal floor space and height dimension needed for the apparatus 10. The horizontally disposed beam 94 has its ends 93, 95 extending beyond the left and right side wall sections 54, 56 through corresponding vertically elongated slots 53, 55 therein for connection, respectively, to the left and right piston assemblies 30, 32, earlier described and illustrated with reference again to FIG. 1. Guide elements in the form of wheels 98, and alternatively pads 99, as illustrated with reference to FIGS. 13 and 13A, are carried by the plate member 92 at edges thereof, for slidable engagement with an inside surface of the left and right side wall sections 54, 56 during the reciprocating movement of the compression plate 26, and minimizing drift and friction between the plate 26 and inside wall surfaces. Slots 100 within the plate member 92 permit the strapping 38 earlier described, to be guided over the waste material for tying and forming the bale.

As illustrated with reference again to FIGS. 12 and 13A, to aid in the forming of the bale 36, and provide a desired compression distribution onto the waste material 34, a pair of opposing top struts 102 extends along opposing left and right edges 104, 106 of the plate member 92 for cooperating with the arched surface 22 and the struts 86 in compressing of the waste material. The pair of opposing top struts 102 enhance compression of the waste material along left and right side and lower portions 108, 110 of the arched floor plate. Noting FIG. 3A, tapered tabs 112 aligned with slots 100 and extend from front and rear inside wall surfaces 114, 116 of the chamber, to enhance compaction by restricting upward expansion of the compressed waste material 34.

Figure 14:
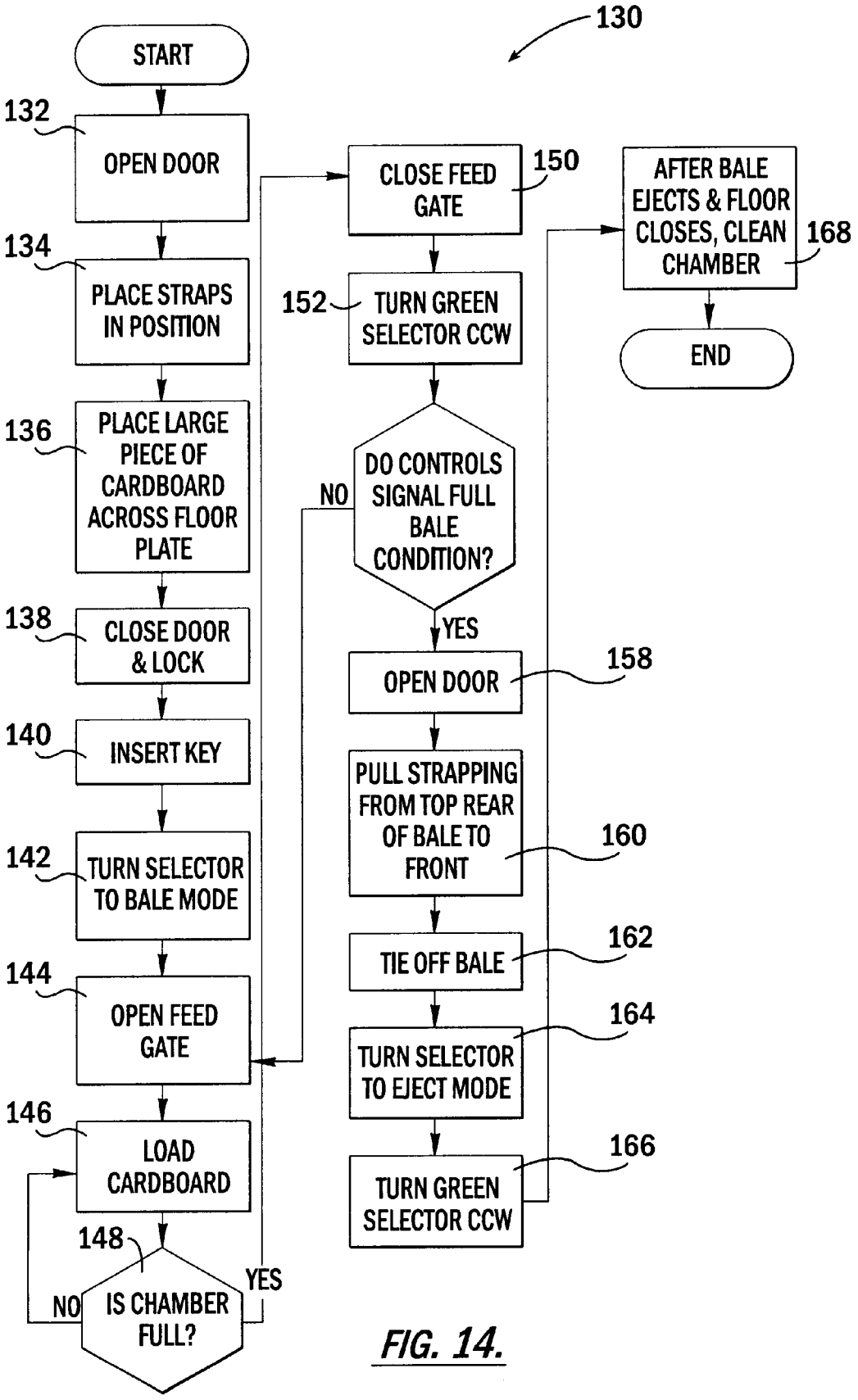
FIG. 14 is a flow diagram illustrating one operation of the baling apparatus of the present invention.

The apparatus 10 provides for safe operation by an operator. As illustrated with reference to the flow chart of FIG. 14, one preferred operating procedure, referred to generally as 130, includes the first step 132 of opening the chamber door 46 and then, at step 134, placing the strapping 38 for subsequent wrapping and tying of the compacted waste material 34. A preferred procedure, step 136, includes the placing of a sheet of cardboard onto the arched surface 22 of the floor plate 20 for providing a uniform bale bottom surface 82. At step 138, the door 46 is then closed and secured in place using the door latch 60 as earlier described. For added safety, at step 140 a key is needed to select a baling mode of operation. As shown at steps 142, 144 and 146, with the door 46 closed and latched, the feed gate 65 is opened and waste material loaded into the chamber 16 with the compression plate 26 in its fully retracted position above the chamber. Sensors 115 communicating with the controller 117 are operable with the plate 92 for detecting plate position and thus chamber capacity, by way of example. When the chamber 16 is filled as desired as determined at steps 148, the feed gate 65 is closed at step 150 and, at step 152, the controller 117 operated by a keyed switch 118 initiates the compression process by pulling of the compression plate 26 by the left and right piston assemblies 30, 32 if door and gate sensors 120 indicate a closed position at step 150. The location sensors 116 detect the position of the compression plate 26 to determine if a full bale condition exists. If a desired full bale is possible, the door 46 is opened at step 158 while the compression plate is in a compressing position, and the bale tied with the strapping 38 at step 162, after feeding the strapping around the waste material at step 160. The tied bale 36 is then ejected from the chamber by activating an eject mode using the keyed switch at steps 164, 166. The bale 36 is pushed from the chamber 16 as earlier described. Once ejected at step 168, the floor plate 20 is retracted back into the chamber 16, the door closed, and apparatus 10 is ready for operation in preparing another bale.

Safety is of primary concern as emphasized throughout the above description, including operation of the gate swing out and downward to keep the operator distanced from potentially dangerous operable elements. Noting FIG. 1A, additional safety features include a handle 122 extending from the frame 67 and a textured frame corner 123 to discourage the operator from resting his hand on the gate. In yet another embodiment of the gate 65, as illustrated with reference again to FIG. 2, an elongate gate handle 124 is provided for raising and lowering the gate. The handle 124 is positioned to avoid pinching of operator hands by the gate edges.

It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

That which is claimed is:

1. A baling apparatus comprising:

a base;

a wall vertically extending from the base for defining a chamber having an open top end;

a horizontally disposed floor plate having an arched top surface, the floor plate carried by the base for providing a closed bottom end of the chamber;

a compression plate mounted above the base for reciprocating movement within the chamber;

first reciprocating means carried outside the wall for reciprocating the compression plate relative to the chamber, wherein waste material loaded into the chamber is compacted between the compression plate and the floor plate while confined by the vertically extending wall;

pusher tabs vertically extending from a rear edge of the floor plate for cradling the waste material; and second reciprocating means operable with the floor plate for horizontal reciprocation of at least a portion of the floor plate from within the chamber to outside the chamber through an opening within the wall, wherein waste material compacted within the chamber is pushed therefrom.

2. The apparatus according to claim 1, further comprising a chamber door forming a front portion of the wall, the chamber door pivotally secured along a vertical side thereof for providing access to the chamber and exposing the floor plate for slidable movement of the waste material from the chamber when the door is in an open position.

3. The apparatus according to claim 2, further comprising locking pins extending from the wall for engaging the chamber door for securing the door to the side walls during compression of the waste material.

4. The apparatus according to claim 2, further comprising a feed gate moveably secured with the front portion for providing access to the chamber above the chamber door wherein the waste ;Material is loaded into the chamber when the feed gate is in an open position.

5. The apparatus according to claim 4, further comprising a frame formed with the chamber door and upwardly extending therefrom, with the feed gate carried by the frame.

6. The apparatus according to claim 5, wherein the frame is hingedly connected to the wall for providing access to the chamber through a simultaneously outwardly swinging movement of the feed gate and chamber door.

7. The apparatus according to claim 1, wherein the floor plate comprises at least one telescoping plate sections.

8. The apparatus according to claim 1, further comprising at least one elongate strut carried on a top surface of the floor plate for forming a depression within a bale formed during the compression of the waste material.

9. The apparatus according to claim 8, wherein the at least one elongate strut comprises two struts spaced for enhancing slidable movement of a fork lift under a bale formed by the apparatus.

10. The apparatus according to claim 1, further comprising strapping means operable therewith for permitting the compacted waste material to be strapped.

11. The apparatus according to claim 1, wherein the first reciprocating means comprises first and second reciprocating pistons operably connected between the base and the compression plate.

12. A baling apparatus comprising:

a base;

a wall vertically extending from the base for defining a chamber having an open top end;

a horizontally disposed floor plate having an arched top surface, the floor plate carried by the base for providing a closed bottom end of the chamber;

a compression plate mounted above the base for reciprocating movement within the chamber;

first reciprocating means carried outside the wall for reciprocating the compression plate relative to the chamber, wherein waste material loaded into the chamber is compacted between the compression plate and the floor plate while confined within the vertically extending wall;

pusher tabs vertically extending from a rear edge of the floor plate for cradling the waste material;

second reciprocating means operable with the floor plate for horizontal reciprocation of at least a portion of the floor plate from within the chamber to outside the chamber through an opening within the wall, wherein waste material compacted within the chamber is pushed therefrom;

the compression plate comprising a plate member; and a beam connected to the plate member by a vertical support for securing the beam in a spaced relation to the plate member, the beam horizontally extending beyond the wall for connection to the first reciprocating means.

13. The apparatus according to claim 12, further comprising low friction means carried by the plate member for slidable engagement with an inside surface of the wall during the reciprocating movement of the compression plate.

14. The apparatus according to claim 12, further comprising a pair of opposing struts extending along opposing edges of the plate member for shaping a bale formed in the compressing of the waste material, the pair of opposing struts enhancing compression of the waste material along a lower portion of the floor plate.

15. A baling apparatus comprising:

a horizontally disposed floor plate having an arched surface for receiving material to be compacted thereon;

a compression plate mounted for reciprocating vertical movement with respect to the floor plate;

first reciprocating means operably attached between the horizontally disposed floor plate and the compression plate for reciprocating the compression plate relative to the floor plate, wherein material placed between the floor plate and the compression plate is compacted therebetween for forming an arched bottom surface therein;

the compression plate comprising a plate member; and a beam connected to the plate member by a vertical support for securing the beam in a spaced relation to the plate member, the beam secured to the first reciprocating means.

16. The apparatus according to claim 15, further comprising at least one elongate strut carried on a top surface of the floor plate for forming a depression within a bale formed during the compression of the material.

17. The apparatus according to claim 16, wherein the at least one elongate strut comprises two struts spaced for enhancing slidable movement of a fork lift under a bale formed by the apparatus.

18. The apparatus according to claim 15, wherein the first reciprocating means comprises first and second hydraulic pistons operably connected between the base and opposing ends of the beam.

19. The apparatus according to claim 15, further comprising a pair of opposing struts extending along opposing edges of the plate member for shaping a bale formed in the compressing of the material, the pair of opposing struts enhancing compression of the material along a lower portion of the floor plate.

20. A baling apparatus comprising:

a horizontally disposed floor plate having an arched surface for receiving material to be compacted thereon;

a compression plate mounted for reciprocating vertical movement with respect to the floor plate;

first reciprocating means operably attached between the horizontally disposed floor plate and the compression plate for reciprocating the compression plate relative to the floor plate, wherein material placed between the floor plate and the compression plate is compacted therebetween for forming an arched bottom surface therein;

the compression plate comprising a plate member;

a beam connected to the plate member by a vertical support for securing the beam in a spaced relation to the plate member, the beam secured to the first reciprocating means;

pusher tabs vertically extending from an edge of the floor plate; and second reciprocating means operable with the floor plate for horizontal reciprocation of the floor plate for biasing the pusher tabs against the material in a horizontal pushing movement, wherein material compacted between the compaction plate and the floor plate is pushed therefrom with the arched bottom surface placed onto a support surface.

21. The apparatus according to claim 20, wherein the floor plate comprises at least one telescoping plate section.

22. A baling apparatus comprising:

a horizontally disposed floor plate;

a compression plate mounted for reciprocating vertical movement with respect to the floor plate;

at least one elongate strut carried on at least one of the floor plate and the compression plate for forming a depression within a bale formed during compression of material placed between the compression plate and the floor plate;

reciprocating means operably attached between the horizontally disposed floor plate and the compression plate for reciprocating the compression plate relative to the floor plate, wherein the material placed between the floor plate and the compression plate is compacted therebetween;

the compression plate comprising a plate member; and a beam connected to the plate member, the beam also secured at ends thereof to the reciprocating means.

23. The apparatus according to claim 22, wherein the at least one elongate strut comprises two struts carried by the floor plate in spaced relation thereon for enhancing slidable movement of a fork lift under a bale formed by the apparatus.

24. The apparatus according to claim 22, wherein the at least one elongate strut comprises two struts carried by the compression plate in spaced relation thereon for providing a preselected shaped compression of the material.

25. The apparatus according to claim 22, wherein the floor plate comprises an arched top surface for receiving the material thereon.

26. The apparatus according to claim 22, wherein the reciprocating means comprises first and second reciprocating pistons each operably connected between the base and one of the beam ends.

27. A method for compacting material and baling thereof, the method comprising the steps of:

providing a baling apparatus having a chamber defined by enclosing front, rear and sidewalls carried on a base and a vertically reciprocating compression plate operable above the base for compacting the material in the chamber;

horizontally disposing a floor plate onto the base for providing a closed bottom end of the chamber, the floor plate having an arched top surface for forming an arched bottom surface of the compacted material;

placing a beam across the compression plate, the beam having opposing ends each of which extends beyond an adjacent sidewall of the chamber;

fitting first and second generally vertical reciprocating pistons each along the outside of one of the sidewalls and each operably coupled at a lower end to the base and at an upper end to a corresponding end of the beam;

loading material to be compressed into the chamber; and compressing the material by reciprocating the compression plate relative to the chamber, wherein the material loaded into the chamber is compacted between the compression plate and the arched top surface of the floor plate.

28. The method according to claim 27, wherein the baling apparatus further comprises a chamber door moveably secured to the front wall for providing access to the chamber, and wherein the method further comprises the steps of:

opening the door for providing access to the chamber and exposing the floor; and horizontally pushing the compacted material from the chamber for positioning the compacted material onto a surface adjacent the apparatus for placing a lifting fork element into a cavity formed by the surface and the arched material bottom surface.

29. The method according to claim 28, further comprising the steps of:

closing the door; and securing the door to a sidewall prior to the compressing step for locking engagement of the door therewith.

30. The method according to claim 28, wherein the baling apparatus further comprises a feed gate means secured above the door for providing access to the chamber, and wherein the step of loading the material into the chamber comprises the steps of opening the feed gate for the material loading step and closing the feed gate for the compressing step.

31. The method according to claim 28, further comprising the steps of: placing a lifting fork element into the cavity formed by the support surface and the arched bottom surface of the compacted material; and lifting the compacted material for transporting thereof.

32. The method according to claim 27, further comprising the step of attaching at least one elongate strut onto the top surface of the floor plate for forming a depression within a bale formed during the material compressing step.

33. The method according to claim 32, wherein the at least one elongate strut attaching step comprises the step of attaching two struts in a spaced relation for enhancing slidable, movement of a lifting fork element under the compacted material.

34. The method according to claim 27, further comprising the steps of extending a pair of opposing struts along opposing edges of the compression plate for shaping a bale formed in the compressing of the waste material, the pair of opposing struts enhancing compression of the waste material along a lower portion of the floor plate.

35. The method according to claim 27, further comprising the step of strapping the compacted material for forming a bale.

36. The method according to claim 27, further comprising the step of reducing frictional contact between the wall surfaces and the compacted material.

37. The method recited in claim 27, further comprising the step of dimensioning the first and second vertical reciprocating pistons to a dimension within the dimension between the upper and lower extremities of the adjacent sidewalls.

* * * * *